US006250259B1

(12) United States Patent
Herz et al.

(10) Patent No.: US 6,250,259 B1
(45) Date of Patent: Jun. 26, 2001

(54) FLOW-THROUGH HEATER FOR HEATING WATER

(75) Inventors: Volker Herz, Bacharach; Andreas Birk, Bad Homburg; Karl-Heinz Kamprath, Wiesbaden, all of (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/431,827

(22) Filed: Nov. 2, 1999

(30) Foreign Application Priority Data

Nov. 17, 1998 (DE) ..... 198 52 886

(51) Int. Cl.[7] ..... F24H 1/10
(52) U.S. Cl. ..... 122/511; 122/364; 392/480
(58) Field of Search ..... 122/493, 495, 122/496, 364, 235.19, 235.15, 510, 511; 392/465, 479, 480

(56) References Cited

U.S. PATENT DOCUMENTS

| | | | | |
|---|---|---|---|---|
| 4,778,977 | * | 10/1988 | Bleckman | 392/480 |
| 4,904,845 | * | 2/1990 | Wonka | 392/480 |
| 5,150,488 | * | 9/1992 | Salomon | 392/480 |
| 5,192,937 | | 3/1993 | Lee . | |
| 5,283,854 | * | 2/1994 | Schiebelhuth | 392/480 |

FOREIGN PATENT DOCUMENTS

| | | |
|---|---|---|
| 173569 | 1/1953 | (AT) . |
| 195 05 621 | 8/1996 | (DE) . |
| 196 05 187 | 8/1997 | (DE) . |

* cited by examiner

*Primary Examiner*—Gregory Wilson
(74) *Attorney, Agent, or Firm*—Fish & Richardson P.C.

(57) ABSTRACT

The invention is directed to a protective device for a heating unit, in particular for a flow-through heater (22), which is equipped with a current-carrying conductor (1) having a first end thereof mechanically biased into contact with a first fixed point of connection (40) and a second end (23) thereof soldered to a second point of connection (10). In the event of an error condition due to overheating, the bias operates to move the conductor (1) away from the second point of connection (10), severing the soldered joint in the process, whereby the circuit is opened. According to the present invention, the point of connection (10) is formed by a terminal stud (12), and the end (23) of the conductor (1) needing to be soldered to the terminal stud (12) is shaped in such manner that a sufficiently large soldered joint (16) requiring wetting by the solder (15) is developed. Even where thin wires are used, a particularly large-area and hence solid solder connection is thereby accomplished which has a better thermal effect on the soldered joint (16) and therefore enables a quicker acting protective device to be obtained.

6 Claims, 3 Drawing Sheets

FLOW-THROUGH HEATER FOR HEATING WATER

This invention relates to a flow-through heater for heating water for domestic use in accordance with the prior-art portion of claim 1.

Such a flow-through heater with a protective device is described in DE 196 05 187 A1 and used, for example, in coffee and tea makers. For normal operation such domestic appliances are equipped with a safety switch which, in cooperation with the temperature control device, interrupts the power supply to the domestic appliance under critical temperature and error conditions. This temperature protective device is, as a rule, sufficient to disconnect the appliance from the electrical supply, as on a failure of the temperature control device which is conventionally equipped with a bimetal. However, if in the presence of an adverse phase position and a defective temperature control device a short circuit occurs to the effect that heating conductor sections of a tubular heating element are electrically connected to a protective conductor, an uncontrolled heating of the tubular heating element may occur and produce an environmental hazard.

To master such an error condition, DE 196 05 187 A1 initially referred to describes a temperature fuse in which a mechanically biased conductor, which disconnects by melting of the solder, interrupts the power supply to the tubular heating element of the flow-through heater. The aforementioned solution requires, however, a special element for carrying the soldered joint and connecting with the terminal stud of the tubular heating element. In this arrangement, the connecting element is comprised of a flat soldering lug which, owing to its bigger soldering surface, establishes a fixed connection from the terminal stud to the conductor through the intermediary of the solder. Apart from additional expenditure of material, the use of such a connection element adds to the complexity of production, requiring in particular the soldering end to be of a flat and wide configuration. This presents a problem in cases where a round and relatively thin wire is employed.

It is therefore an object of the present invention to simplify the flow-through heater construction for the purposes of production without impairing the achieved level of operational reliability, while at the same time enhancing its functionality and safety.

This object is accomplished in the flow-through heater of the type initially referred to by the features identified in patent claim 1. Soldering the conductor directly with the terminal stud of the heating element due to the special shaping of the terminal connector of the conductor eliminates the need for the connector element so far used. By shaping the conductor end as disclosed in the invention, it is possible to fill the space enclosed by the conductor end with solder fully or to the fullest possible extent, and this particularly because liquid solder is capable of covering surfaces up to a specified size (globule size), maintaining this covering position until the solder has cooled down and become hard. Furthermore, this presents an advantage in automated production for the purposes of a secure positioning. It is then also possible for the wire to embrace partially the terminal stud over one or several partial sections which then establish an intimate soldered connection with the terminal stud during soldering.

Owing to the special shaping of the terminal connector of the conductor, the soldering surface between the conductor end and the contact tab of the heater is enlarged. The present invention finds application particularly advantageously with conductors of circular cross section (claim 2). It will be understood, however, that the use of oval or rectangular terminal studs or terminal studs of any other cross section is possible, the conductor end being then shaped to extend in conformity with the stud's outer shell surface essentially over one or several partial areas.

A round or oval wire offers, however, a connecting surface to the terminal stud which is partly closed all-round.

For production-related reasons, it is further advantageous to configure the conductor in accordance with patent claims 3 and 4. These approaches enable the aforementioned features to be implemented particularly simply and effectively, the conductor end then embracing the shell surface of the terminal stud over a specified partial area only or engaging with its partial area the shell surface of the terminal stud wholly or, due to non-circular manufacturing tolerances, only partially.

In particular with regard to automated production and reliable placement of the conductor on the terminal stud provision is furthermore made in patent claim 5 for the soldered joint to be arranged a sufficient distance from the end of the terminal stud in the direction of the heating element, and for the conductor to be of a length not protruding beyond the end of the terminal stud.

Overall, for the solutions set forth it is advantageous if the conductor is a spring wire of round cross section.

With the features of claim 6 the number of necessary components is reduced and hence manufacture and assembly of the flow-through heater are simplified while good compliance with the predetermined breaking values under error conditions is ensured. Owing to the large-surface soldering using round wires as disclosed in the invention, a stable protective device in the form of a junction having the added function of a fusible cutout is accomplished.

Further details and advantages of the protective device of the present invention will become apparent from the description of embodiments illustrated in the accompanying drawing, wherein.

Figure 3:
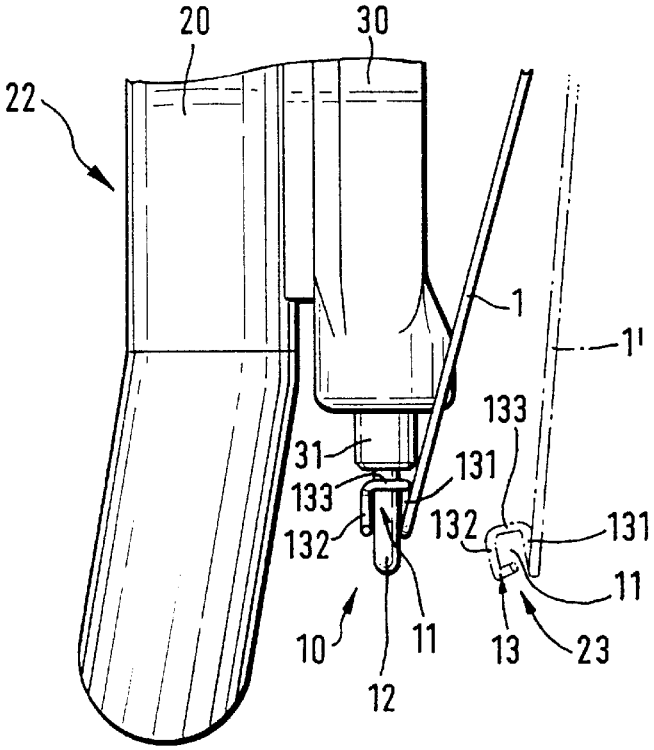
Figure 4:
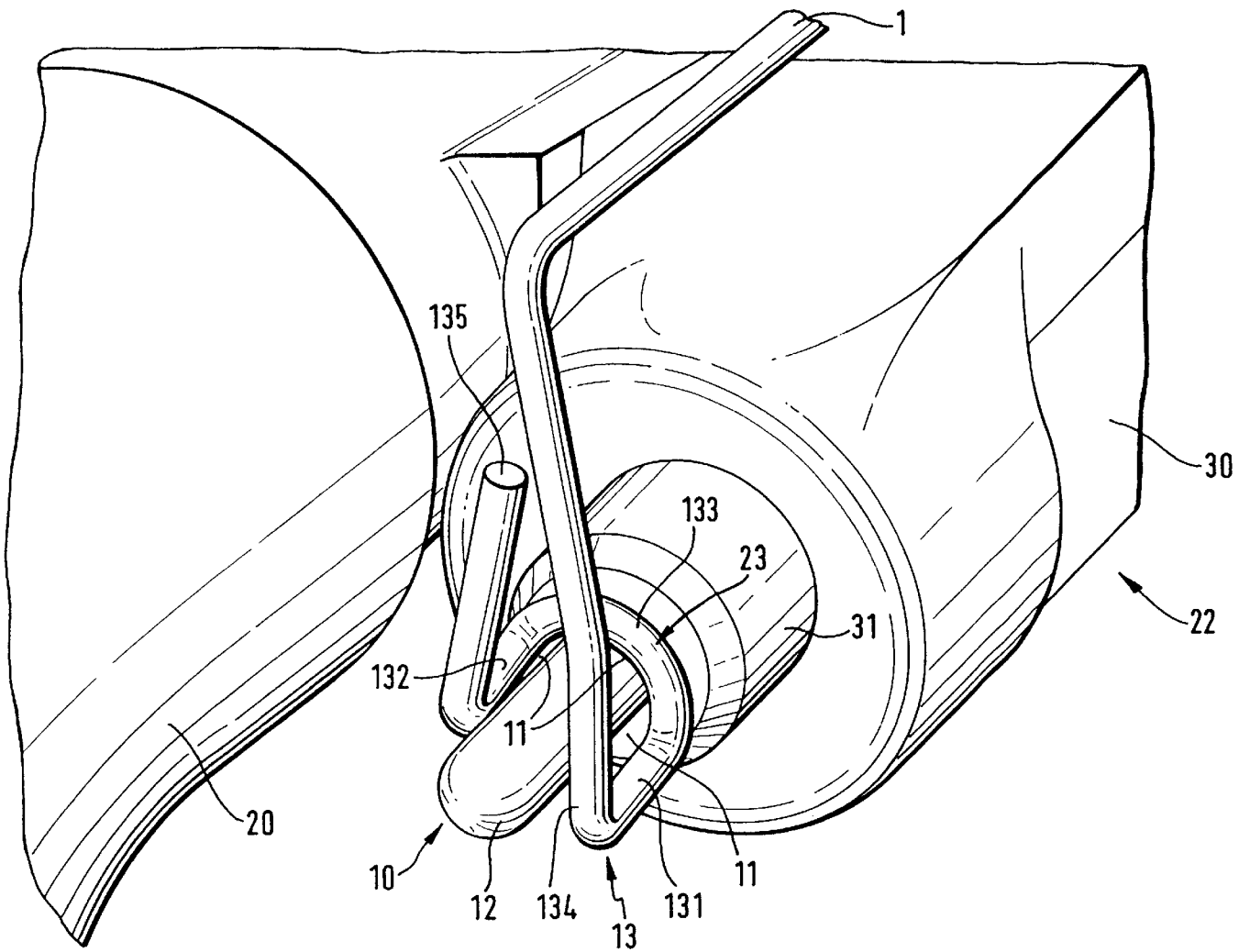

FIG. 3 is a schematic representation both prior and subsequent to the application of the conductor end to the junction of FIG. 1, but as seen when looking from below at the flow-through heater; and FIG. 4 is a partial perspective view, from the front, of the left-hand end of the flow-through heater according to the direction of arrow X of FIG. 1, on a greatly enlarged scale, but only showing the loop seated onto the terminal stud.

Figure 1:
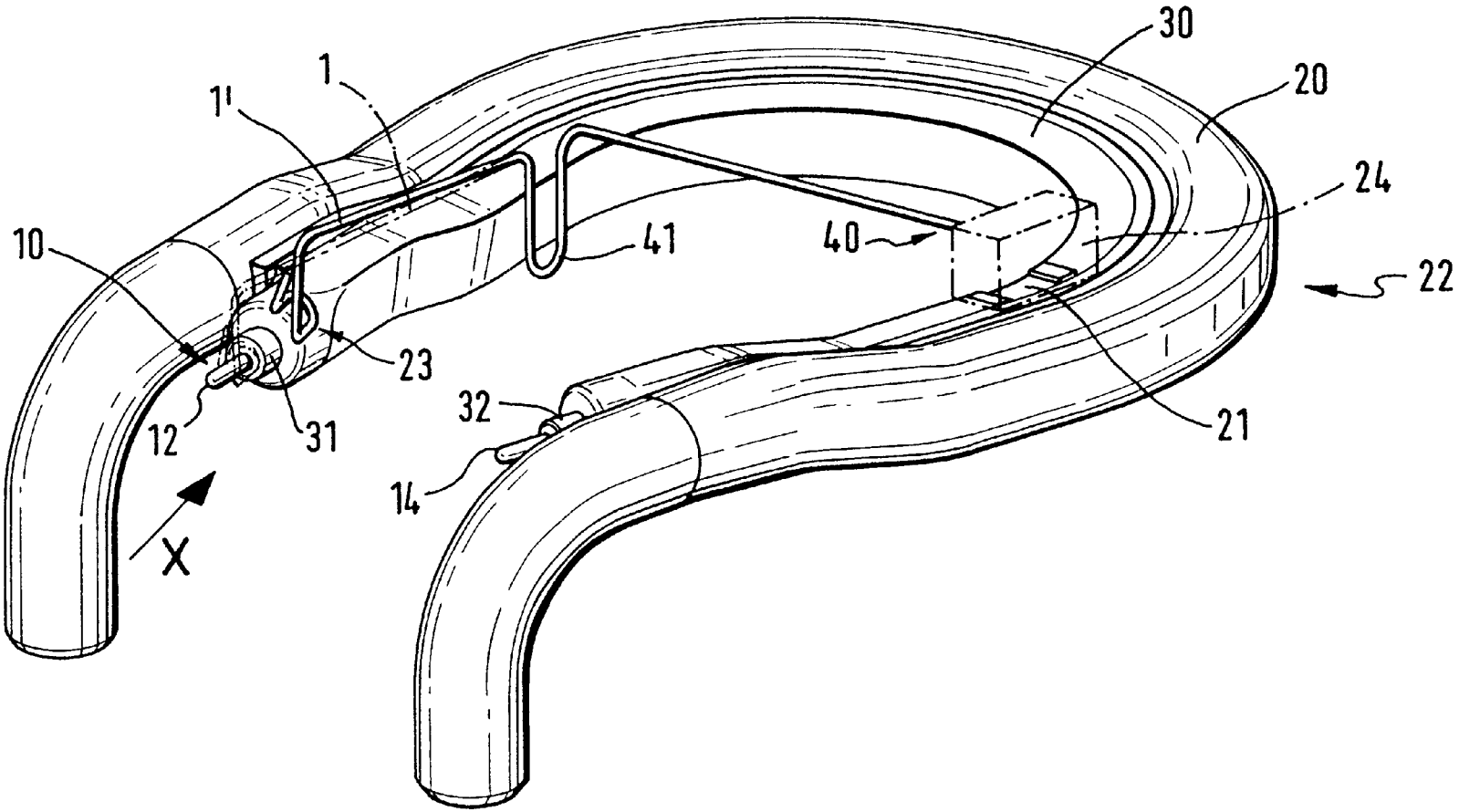
FIG. 1 is a schematic view of the essential parts of a flow-through heater of the present invention, showing a wire end in seating engagement with the stud in opposition to a spring force directly prior to the soldering operation, in addition to showing a wire end removed from the stud before the wire end is urged downwards.

The flow-through heater 22 of FIG. 1 is comprised of a water pipe 20 with which a heating element 30 is in intimate thermal contact. As becomes apparent from FIG. 1, protruding from the heating element 30 are terminal studs 12 and 14 circular in cross section and sheathed by electrical insulating material 31 and 32, the studs being connected with heating wires (not shown) embedded in the heating element 30 in insulating fashion. The protective device is comprised of the conductor 1 which is fixedly attached to a first point of connection 40 of a thermostatic control device 24 mounted on the flow-through heater 22 at a site 21. The thermostatic control device 24 controls the temperature of the flow-through heater 22. The point of connection 40 is also used for supplying power from the thermostat 24 through the conductor 1 to the terminal stud 12 and hence to the heating wire.

According to FIG. 1, the conductor 1 which is a spring wire has a U-shaped portion 41; its significance is set forth in detail in DE 196 05 187 A1 initially referred to, whose content is hereby incorporated in the present description by express reference.

To connect the conductor 1 to the heating element 30, the terminal stud 12 has a second point of connection 10, as shown in FIGS. 1 to 4. During production, the conductor 1 is resiliently urged against this point of connection 10 and soldered thereto by a solder over a large area, which is however only schematically indicated in FIG. 2.

Figure 2:
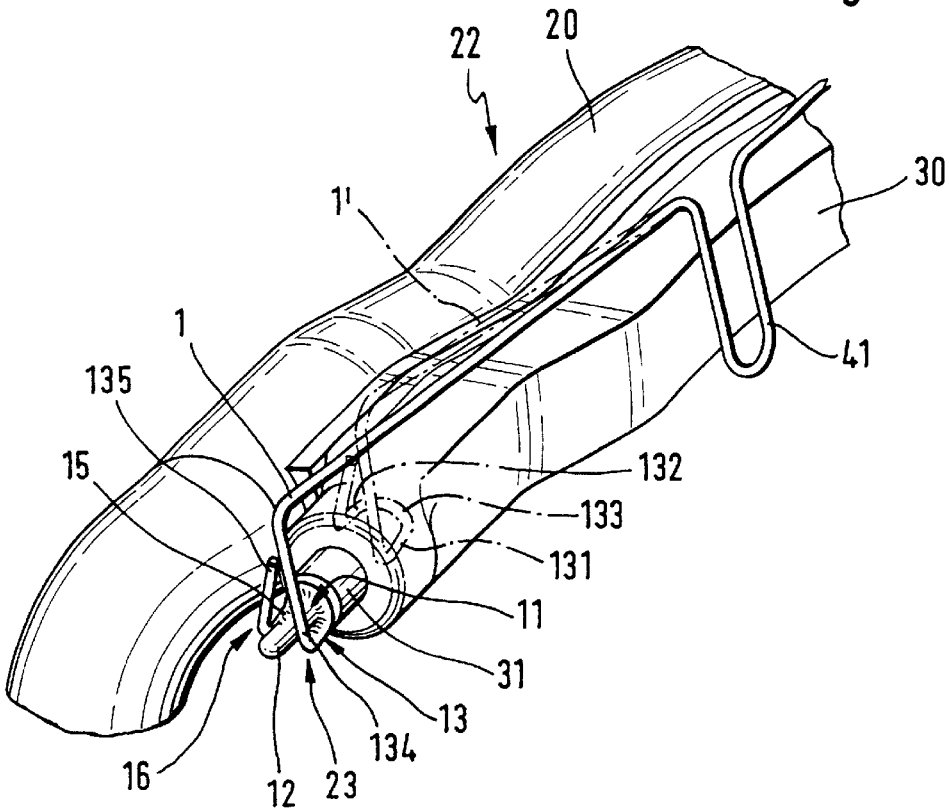
FIG. 2 is a detail view of the embodiment of the junction of FIG. 1, showing the essential elements in the area of the point of connection on an enlarged scale, but subsequent to the soldering of the present invention, which serves at the same time as protective device.

When the heating element is overheated due to a defect as, for example, a short circuit, the area of the point of connection 10 of the terminal stud 12 is exposed to high heat. As a result, the solder (FIG. 2) which has accumulated in the area of the loop-shaped end 23 of the conductor 1 during soldering softens and melts. Considering that the conductor 1 is biased into engagement with the terminal stud 12 and soldered thereto, the conductor 1 springs back from the terminal stud 12 when the solder 15 is molten, thereby interrupting the flow of current; hence no further heating takes place. FIG. 2 shows both conditions of the conductor 1, including the condition of the conductor 1 as soldered with the terminal stud 12 by solder 15, and the condition of the conductor 1' as severed and moved away from the terminal stud 12. FIGS. 1 and 3 show equally two conditions of the conductor 1, including however only the conductor 1 as engaged with the terminal stud 12 prior to the soldering operation, and the conductor 1' as removed from the terminal stud 12.

As becomes apparent from FIG. 4, the end 23 of the conductor 1 is of a planar configuration due to its loop shape so that a sufficiently large, defined surface area 11 (FIG. 3) is obtained for wetting by the solder 15, which is additionally supported by the fact that the contact surfaces (not shown) at the point of connection 10, meaning those of the conductor 1 and of the terminal stud 12, have matching contours and hence are in snug relative engagement. In FIG. 4 the solder 15 is not shown.

FIGS. 2 and 4 illustrate, on an enlarged scale, the simple and, from the point of view of manufacturing engineering, advantageous shape of the conductor 1 with which a surface area 11 can be developed which enables the reliable, predetermined flux of the solder 15 and ensures an operationally reliable large area connection between the conductor 1 and the terminal stud 12. For this purpose, the conductor 1 has its appropriate end bent to form a loop 13 encompassing the area 11, as is also shown in FIG. 3. As becomes apparent particularly from FIG. 4, the two legs 131 and 132 extending parallel to the terminal stud 12 will produce a secure soldered connection if the solder 15 adheres to the facing surfaces 11 of the legs 131 and 132 and the terminal stud 12 (not shown). Further contributing to this is the connecting bridge 133 guided around and conformed to the contour of the terminal stud 12 in a U-shaped configuration. The exact determination of the form of the loop 13 is made with due consideration of the dimensions of the components, that is, the respective diameters (wire) and other dimensions. As becomes equally apparent, the shape of the loop 13 is selected to extend in upward direction so as to positively preclude catching on the terminal stud 12 inadvertently. Also serving this function is in particular the loop end 135 which extends upwardly in a direction essentially transverse to the terminal stud 12 and is led back to the loop start 134. In this manner, should the loop 13 come underneath the terminal stud 12 accidentally when the conductor 1 is bent down, the loop will invariably slip away to the right side and, once released, upwards again, so that it can be reseated onto the terminal stud 12 readily, as FIG. 4 shows. The shapes of the loop start 134, the loop end 135 and the connecting bridge 133 extending upwardly in U-shape are selected to eliminate the possibility for them to slip sideways along the terminal stud 12 prior to soldering in the position shown in FIG. 4, because the U-shaped connecting bridge 133 centers itself on the terminal stud 13 roughly conformed in diameter.

The length of the conductor 1 is selected so that the loop 13 ends short of the free end of the terminal stud 12 in order to equally obviate the possibility for the loop to engage underneath the stud when the conductor 1 with the connecting bridge 133 is pressed down. This is necessary particularly in automated production to prevent the loop 13 from hooking under the terminal stud 12. Similarly, the loop 13 is shaped to a size so that the conductor 1 with the loop 13 does not protrude beyond the end of the terminal stud 12, as all the Figures show. During soldering the solder (not shown) flows into the gap formed between the loop 13 and the terminal stud 12. For this purpose, the diameter of the connecting bridge 133 is slightly larger than the diameter of the terminal stud 12.

Practical tests performed with this protective device have revealed that the response of the fuse is improved over hitherto known solutions because the partial engagement of the loop 13 around the terminal stud 12 produces a larger contact surface adapted to be exposed to a higher amount of heat. Hence, as soon as the solder reaches the melting point on overheating of the flow-through heater, the conductor 1 moves instantly away from the terminal stud 12, breaking the circuit. This avoids fire hazards when the normal temperature control device is defective.

What is claimed is:

1. A flow-through heater (22) for heating water for domestic use, with a current-carrying conductor (1) having one end thereof soldered to a point of connection (10) by means of a solder (15) to form a soldered joint (16), characterized in that the point of connection (10) is formed by a terminal stud (12), and that the end (23) of the conductor (1) needing to be soldered to the terminal stud (12) substantially conforms to the outer contour of the terminal stud (12) in one or several partial areas.

2. The flow-through heater as claimed in claim 1, characterized in that the terminal stud (12) is of circular cross-section.

3. The flow-through heater as claimed in claim 2, characterized in that the conductor (1) has its end (23) needing to be soldered bent in the manner of a loop, and that the area requiring wetting by the solder (15) is bounded by the loop.

4. The flow-through heater as claimed in claim 3, characterized in that the loop-shaped configuration of the conductor (1) is selected so that two legs (131, 132) of the loop (13) extend parallel to the longitudinal axis of the terminal stud (12), preventing catching on the terminal stud (12).

5. The flow-through heater as claimed in any one of the preceding claims, characterized in that the soldered joint (16) is arranged a sufficient distance from the end of the terminal stud (12) in the direction of the heating element (30), and that the conductor (1) is of a length not protruding beyond the end of the terminal stud (12).

6. The flow-through heater as claimed in claim 1, characterized in that added provision is made for the conductor (1) to have a first end thereof mechanically biased into contact with a further fixed point of connection (40), and that the conductor (1), in the event of an error condition due to overheating of the flow-through heater (22), moves away from the second point of connection (10) by reason of the bias, the soldered joint (16) being severed in the process and the circuit being thereby interrupted.

* * * * *